US011330867B2

(12) United States Patent
Craven, Sr.

(10) Patent No.: US 11,330,867 B2
(45) Date of Patent: May 17, 2022

(54) REMOVABLE SHOE LACE REPLACEMENT OVERLAY AND METHOD OF USING SAME

(71) Applicant: William I. Craven, Sr., Scranton, PA (US)

(72) Inventor: William I. Craven, Sr., Scranton, PA (US)

( * ) Notice: Subject to any disclaimer, the term of this patent is extended or adjusted under 35 U.S.C. 154(b) by 58 days.

(21) Appl. No.: 16/894,825

(22) Filed: Jun. 7, 2020

(65) Prior Publication Data

US 2020/0297077 A1 Sep. 24, 2020

Related U.S. Application Data

(63) Continuation-in-part of application No. 15/858,031, filed on Dec. 29, 2017, now abandoned.

(Continued)

(51) Int. Cl.
*A43B 23/26* (2006.01)
*A43C 11/20* (2006.01)

(Continued)

(52) U.S. Cl.
CPC ..... *A43B 23/26* (2013.01); *A43B 3/24* (2013.01); *A43B 23/24* (2013.01); *A43C 11/20* (2013.01)

(58) Field of Classification Search
CPC ..... A43B 23/24; A43B 23/26; A43B 23/045; A43B 23/047; A43B 3/24; A43C 11/002; A43C 11/004; A43C 11/006

(Continued)

(56) References Cited

U.S. PATENT DOCUMENTS 2,140,302 A * 12/1938 Roberts ..... A43C 11/002 36/51
2,632,260 A * 3/1953 Herceg ..... A43B 23/26 36/54

(Continued)

FOREIGN PATENT DOCUMENTS

DE 3124504 A1 * 1/1983 ..... A43B 23/045
FR 2499375 A1 * 8/1982 ..... A43B 5/00

OTHER PUBLICATIONS

U.S. Non-final Office Action dated May 2, 2019 for pending U.S Patent Application of William Craven, U.S. Appl. No. 15/858,031, filed Dec. 29, 2017 (parent application).

(Continued)

*Primary Examiner* — Sharon M Prange
*Assistant Examiner* — Grace Huang
(74) *Attorney, Agent, or Firm* — James R. McDaniel

(57) ABSTRACT

A shoe lace replacement overlay system, including a shoe, wherein the shoe includes a shoe base, a shoe lace region, a notch area such that the notch area includes an elastic member, and first shoe replacement overlay attachments; and a shoe lace replacement overlay having a top side and a bottom side, wherein the top side of the shoe lace replacement overlay includes a shoe lace replacement overlay base having a first edge and a second edge, a plurality of eyelet strips, a plurality of eyelets, an elastic member located substantially between the plurality of eyelet strips, and wherein the bottom side of the shoe lace replacement overlay includes second shoe replacement overlay attachments such that the first shoe replacement overlay attachments and the second shoe replacement overlay attachments interact with each other in order to retain the shoe lace replacement overlay on the shoe lace region.

17 Claims, 5 Drawing Sheets

Related U.S. Application Data

(60) Provisional application No. 62/447,420, filed on Jan. 17, 2017.

(51) Int. Cl.
*A43B 3/24* (2006.01)
*A43B 23/24* (2006.01)

(58) Field of Classification Search
USPC ..... 36/100
See application file for complete search history.

(56) References Cited

U.S. PATENT DOCUMENTS 3,299,543 A * 1/1967 Merritt ..... A43C 1/00 36/54
3,601,909 A * 8/1971 Amendola ..... A43B 5/001 36/44
4,394,803 A 7/1983 Goldstein
4,805,321 A 2/1989 Tonkel
5,307,569 A 5/1994 Melcher
5,778,564 A * 7/1998 Kettner ..... A43B 3/24 36/100
6,212,797 B1 4/2001 Merry et al.
6,408,542 B1 6/2002 Shepard
6,449,881 B1 * 9/2002 Assaf ..... A43B 3/0031 150/143
6,681,503 B2 * 1/2004 Morie ..... A43B 5/02 36/133
6,874,256 B2 * 4/2005 Delgatty ..... A43B 3/0078 36/100
7,412,785 B1 * 8/2008 Navasky ..... A43B 3/24 36/100
7,441,348 B1 10/2008 Dawson
7,765,721 B2 8/2010 Hentz, III
7,975,405 B1 7/2011 Mosher
8,136,267 B2 * 3/2012 Barnett ..... A43B 3/26 36/50.1
9,119,436 B1 * 9/2015 Ardell ..... A43C 11/1493
9,532,626 B2 * 1/2017 Lovett ..... A43C 3/02
9,936,764 B2 * 4/2018 Lo ..... A43B 7/12
10,512,303 B2 * 12/2019 Ramsay ..... A43B 23/0245
10,779,706 B1 * 9/2020 Gonzales ..... A43B 5/18
2004/0128862 A1 * 7/2004 Flack ..... A43C 11/008 36/100
2005/0257404 A1 * 11/2005 Daza ..... A43B 7/32 36/72 R
2007/0227045 A1 * 10/2007 Aveni ..... A43B 3/24 36/54
2013/0036628 A1 2/2013 Hussey
2015/0033583 A1 * 2/2015 Loverin ..... A43C 11/06 36/100
2017/0224047 A1 8/2017 Walker
2018/0263330 A1 * 9/2018 Rhoads ..... A43C 7/02
2018/0271218 A1 * 9/2018 Dupuy ..... A43C 11/16

OTHER PUBLICATIONS

U.S. Final Office Action dated Aug. 19, 2019 for pending U.S. Patent Application of William Craven, U.S. Appl. No. 15/858,031, filed Dec. 29, 2017 (parent application).
U.S. Non-final Office Action dated Jan. 7, 2020 for pending U.S. Patent Application of William Craven, U.S. Appl. No. 15/858,031, filed Dec. 29, 2017 (parent application).

* cited by examiner

REMOVABLE SHOE LACE REPLACEMENT OVERLAY AND METHOD OF USING SAME

CROSS-REFERENCE TO RELATED APPLICATION

The present application is a continuation-in-part application which claims benefit to U.S. patent application Ser. No. 15/858,031, filed on Dec. 29, 2017 which is a continuation-in-part of Provisional Application No. 62/447,420, entitled "Removable Shoe Lace Replacement Overlay and Method of Using Same", filed on Jan. 17, 2017. The applications stated above are hereby incorporated by reference as if set forth in their entirety herein.

FIELD OF THE INVENTION

The present invention is generally related to a removable shoe lace replacement overlay, and more particularly to a shoe lace replacement overlay that is capable of being removed and replaced in order to provide a variety of shoe lace color and/or design combinations without the need to remove the shoe laces from the shoe and methods of using the removable shoe lace replacement overlay.

BACKGROUND OF THE INVENTION

Prior to the present invention, as set forth in general terms above and more specifically below, it is known, to employ various types of shoe overlays, spats or saddles. See for example, U.S. Pat. No. 4,394,803 by Goldstein, U.S. Pat. No. 4,805,321 by Tonkel, U.S. Pat. No. 6,212,797 by Merry et al., U.S. Pat. No. 6,408,542 by Shepherd, U.S. Pat. No. 7,441,348 by Dawson, and U.S. Patent Application Publication 2004/0128862 by Flack. While these various shoe overlays, spats or saddles may have been generally satisfactory, there is nevertheless a need for a new and improved shoe lace replacement overlay that is capable of being removed and replaced in order to provide a variety of shoe lace color and/or design combinations without the need to remove the shoe laces from the shoe and methods of using the removable shoe lace replacement overlay.

It is a purpose of this invention to fulfill these and other needs in the shoe lace replacement overlay art in a manner more apparent to the skilled artisan once given the following disclosure.

BRIEF SUMMARY OF THE INVENTION

A first aspect of the present invention is a shoe lace replacement overlay system, including a shoe, wherein the shoe includes a shoe base, a shoe lace region located adjacent to the shoe base, a notch area/tongue opening located adjacent to the shoe lace region such that the notch area/tongue opening includes an elastic member/shoe tightener for retaining the shoe on a foot of a wearer, and a plurality of a first shoe replacement overlay attachments located in a periphery around the shoe lace region; and a shoe lace replacement overlay having a top side and a bottom, wherein the top side of the shoe lace replacement overlay includes a shoe lace replacement overlay base having a first edge and a second edge, a plurality of eyelet strips located along the first and second edges, a plurality of eyelets located along a length of each of the plurality of eyelet strips, and wherein the bottom side of the shoe lace replacement overlay includes a plurality of a second shoe replacement overlay attachments such that the first shoe replacement overlay attachments and the second shoe replacement overlay attachments interact with each other in order to retain the shoe lace replacement overlay on the shoe lace region.

In one embodiment of the first aspect of the present invention, the first shoe replacement overlay attachments are further comprised of hook and loop fasteners.

In another embodiment of the first aspect of the present invention, the second shoe replacement overlay attachments are further comprised of hook and loop fasteners.

In a still another embodiment of the first aspect of the present invention, the shoe lace replacement overlay includes a tab operatively connected to a first end of the shoe lace replacement overlay.

In a yet another embodiment of the first aspect of the present invention, the shoe lace replacement overlay base is constructed of any suitable, durable material such as leather, vinyl or any other suitable stretchable material.

In a further embodiment of the first aspect of the present invention, the eyelet strips are constructed of any suitable, durable material such as leather, vinyl or any other suitable stretchable material.

In a still further embodiment of the first aspect of the present invention, the shoe lace replacement overlay includes a shoe lace such that portions of the shoe lace are located within the eyelets in order to form the shoe lace in a desired pattern.

In an even further embodiment of the first aspect of the present invention, the shoe lace replacement overlay includes a decorative attachment located on the top side of the shoe lace overlay.

A second aspect of the present invention is a shoe having a shoe lace replacement overlay system, including a shoe, wherein the shoe includes a shoe base, a shoe lace region located adjacent to the shoe base, a notch area/tongue opening located adjacent to the shoe lace region such that the notch area/tongue opening includes an elastic member/shoe tightener for retaining the shoe on a foot of a wearer, and a plurality of a first shoe replacement overlay attachments located in a periphery around the shoe lace region; and a shoe lace replacement overlay having a top side and a bottom, wherein the top side of the shoe lace replacement overlay includes a shoe lace replacement overlay base having a first edge and a second edge, a plurality of eyelet strips located along the first and second edges, a plurality of eyelets located along a length of each of the plurality of eyelet strips, and wherein the bottom side of the shoe lace replacement overlay includes a plurality of a second shoe replacement overlay attachments such that the first shoe replacement overlay attachments and the second shoe replacement overlay attachments interact with each other in order to retain the shoe lace replacement overlay on the shoe lace region.

In one embodiment of the second aspect of the present invention, the first shoe replacement overlay attachments are further comprised of hook and loop fasteners.

In another embodiment of the second aspect of the present invention, the second shoe replacement overlay attachments are further comprised of hook and loop fasteners.

In a still another embodiment of the second aspect of the present invention, the shoe lace replacement overlay includes a tab operatively connected to a first end of the shoe lace replacement overlay.

In a yet another embodiment of the second aspect of the present invention, the shoe lace replacement overlay base is constructed of any suitable, durable material such as leather, vinyl or any other suitable stretchable material.

In a further embodiment of the second aspect of the present invention, the eyelet strips are constructed of any suitable, durable material such as leather, vinyl or any other suitable stretchable material.

In a still further embodiment of the second aspect of the present invention, the shoe lace replacement overlay includes a shoe lace such that portions of the shoe lace are located within the eyelets in order to form the shoe lace in a desired pattern.

In an even further embodiment of the second aspect of the present invention, the shoe lace replacement overlay includes a decorative attachment located on the top side of the shoe lace overlay.

A third aspect of the present invention is a method of constructing a shoe having shoe lace replacement overlay system, including providing a shoe, wherein the shoe includes a shoe base, a shoe lace region located adjacent to the shoe base, a notch area/tongue opening located adjacent to the shoe lace region such that the notch area/tongue opening includes an elastic member/shoe tightener for retaining the shoe on a foot of a wearer, and a plurality of a first shoe replacement overlay attachments located in a periphery around the shoe lace region; providing a shoe lace replacement overlay having a top side and a bottom, wherein the top side of the shoe lace replacement overlay includes a shoe lace replacement overlay base having a first edge and a second edge, a plurality of eyelet strips located along the first and second edges, a plurality of eyelets located along a length of each of the plurality of eyelet strips, and wherein the bottom side of the shoe lace replacement overlay includes a plurality of a second shoe replacement overlay attachments such that the first shoe replacement overlay attachments and the second shoe replacement overlay attachments interact with each other in order to retain the shoe lace replacement overlay on the shoe lace region; and attaching the bottom side of the shoe lace replacement overlay to the shoe such that the shoe lace replacement overlay substantially covers the shoe lace region and the notch area/tongue opening.

In one embodiment of the third aspect of the present invention, the method of constructing a shoe having a shoe lace replacement overlay system includes the step of placing a shoe lace through the plurality of eyelets in a desired lacing pattern.

In another embodiment of the third aspect of the present invention, the method of constructing a shoe having a shoe lace replacement overlay system includes the step of using a tab, operatively connected to a first end of the shoe lace replacement overlay, to remove the shoe lace replacement overlay from the shoe.

In a further embodiment of the third aspect of the present invention, the method of constructing a shoe having a shoe lace replacement overlay system includes the step of placing a decorative attachment located on the top side of the shoe lace replacement overlay.

The preferred shoe lace replacement overlay, according to various embodiments of the present invention, offers the following advantages: ease of use of the shoe lace replacement overlay; lightness in weight; the ability to quickly change from one shoe lace replacement overlay to another; the ability to use a variety of different shoe lace colors; the ability to use a variety of different shoe lace overlay designs; excellent durability; portability; and cost efficiency. In fact, in many of the preferred embodiments, these advantages are optimized to an extent that is considerably higher than heretofore achieved in prior, known shoe overlays, spats or saddles.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

Figure 1:
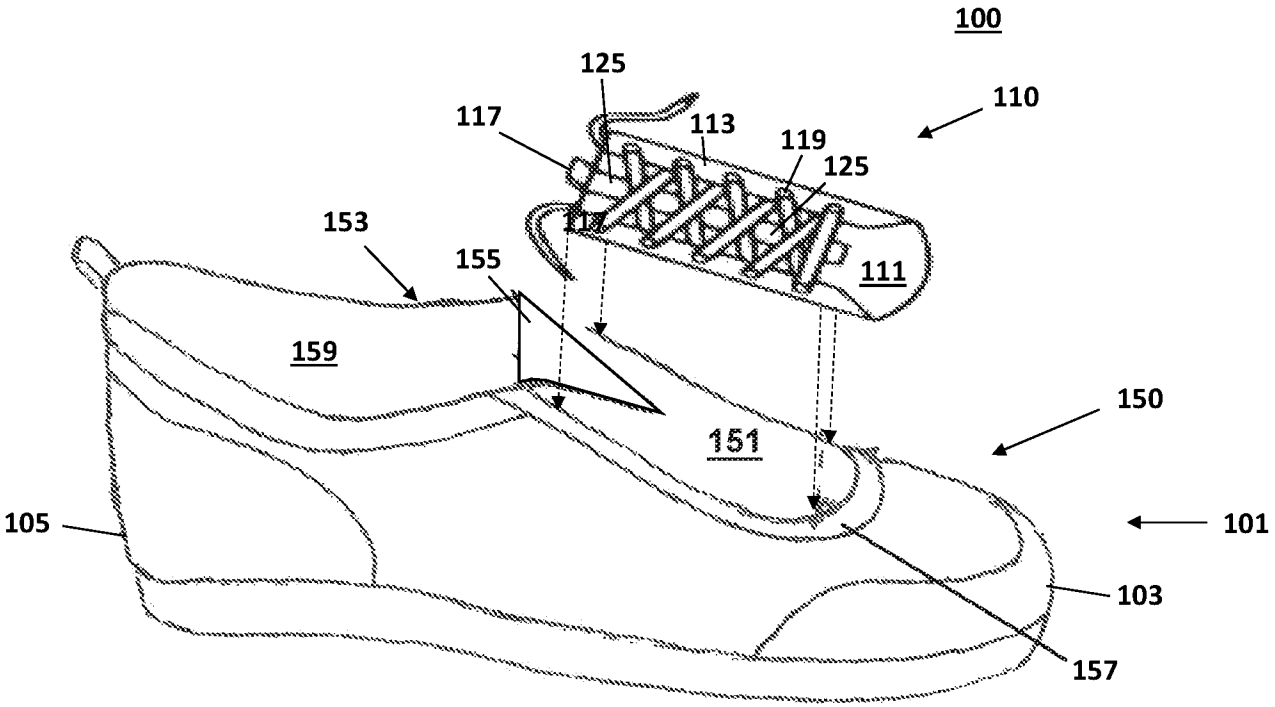
FIG. 1 is a schematic illustration of a shoe having a shoe lace replacement overlay, constructed according to the present invention.

Referring now to FIG. 1, there is illustrated a shoe lace replacement overlay system 100 that is constructed according to the present invention. Shoe lace replacement overlay system 100 includes, in part, shoe 101 and shoe lace replacement overlay 110. Shoe 101 also has a toe portion 103, heel portion 105 and foot opening 159. As will be explained hereinafter in greater detail, the shoe lace replacement overlay 110 is capable of being removed and replaced in order to provide a variety of shoe lace color and design combinations without the need to remove the shoe laces from the shoe 101.

Referring now more particularly to FIG. 1, shoe 101 includes, in part, shoe base 150 having a foot opening 159 into which the wearer's foot is inserted to put on the shoe, shoe lace region 151, notch area/tongue opening 153, elastic member/shoe tightener 155, and shoe replacement overlay attachments 157. It is to be understood that elastic member/shoe tightener 155 is located within notch area/tongue opening 153 and is a conventional elastic member that can be used instead of laces (not shown) to assist in keeping the shoe 101 upon the wearer's foot.

With respect to shoe replacement overlay attachments 157, shoe replacement overlay attachments 157 can be, but are not limited to, a hook-and-loop (e.g., a VELCRO® brand) fastener, snaps, zipper, hooks, magnets or any other suitable, durable attachment means. It is to be even further understood that shoe replacement overlay attachments 157 are conventionally attached to shoe base 150 by any suitable techniques such as by adhesives.

With respect to shoe lace replacement overlay 110, shoe lace replacement overlay 110 includes, in part, shoe lace replacement overlay base 111, eyelet strips 113, laces, tab or loop 117, eyelets 119, and elastic member/shoe lace replacement overlay tightener ("Overlay Tightener") 125. It is to be understood that shoe lace replacement overlay base 111 can be constructed of any suitable, durable material such as leather, vinyl or any other suitable stretchable material. However, it is to be further understood that shoe lace replacement overlay base 111, eyelet strips 113 and shoe base 150 should be constructed of substantially the same material. It is to be even further understood that eyelets 119 can be constructed of any suitable, durable material such as polymeric or metallic materials. It is to be understood that Overlay Tightener 125 is located on shoe lace replacement overlay base 111 and is a conventional elastic member that can be used to assist in providing some flexibility on the shoe lace replacement overlay base 111 and to assist in keeping the shoe lace replacement overlay 110 upon the shoe 101.

Figure 2:
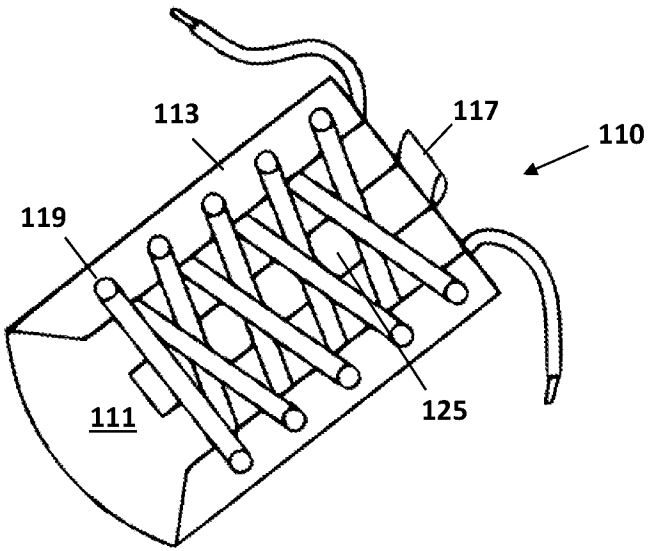
FIG. 2 is a schematic illustration of a top view of the shoe lace replacement overlay of FIG. 1, constructed according to the present invention.

Regarding laces, as shown in FIGS. 1 and 2, laces can be constructed of any suitable, durable material such as cotton, polymeric material, or leather. It is to be understood that the lacing pattern of laces can be varied depending upon the desires of the wearer. A unique inventive concept of the present invention is that the laces may be colored to represent, for example, the colors of the wearer's favorite sports team or the colors of the wearer's sports team. Also, the lacing pattern of laces can be varied. For example, assume that the wearer is a cheerleader. The wearer's high school team colors are blue and yellow. In this example, the wearer wears a yellow cheerleading outfit for away sporting events and laces the laces in a particular pattern for away sporting events. For home sporting events, the wearer wears a blue cheerleading outfit and laces the laces in a different pattern for home sporting events. The present invention allows the wearer to use a shoe lace replacement overlay 110 that includes laces that are yellow and laced in a first pattern for away sporting events and another shoe lace replacement overlay 110 that has blue laces and laced in a different pattern for home sporting events without having to remove the laces from the shoe lace replacement overlay 110. As will be discussed in greater detail later, the wearer simply attaches the desired shoe lace replacement overlay 110 depending upon whether the sporting event that she is going to attend is either home or away.

Regarding eyelet strips 113, as shown in FIGS. 1 and 2, eyelet strips 113 are conventionally formed on shoe lace replacement overlay base 111 by well-known strip folding/forming techniques. The important point being that eyelet strips 113 must be wide enough to provide the proper amount of material to properly retain eyelets 119 within eyelet strips 113 and still somewhat resemble the top of a conventionally tied shoe.

Regarding tab or loop 117, as shown in FIGS. 1 and 2, tab or loop 117 is used to easily remove shoe lace replacement overlay 110 from the shoe lace region 151 and shoe replacement overlay attachments 157. As will be discussed in greater detail later, tab or loop 117 should be constructed so that the wearer can easily grip tab or loop 117. It is to be understood that tab or loop 117 should be constructed of any suitable, durable material such as leather, vinyl or heavy-duty elastic so that the finger of the wearer can easily fit in the tab or lop 117 in order to remove shoe lace replacement overlay 110 from shoe lace region 151 and shoe replacement overlay attachments 157.

Figure 3:
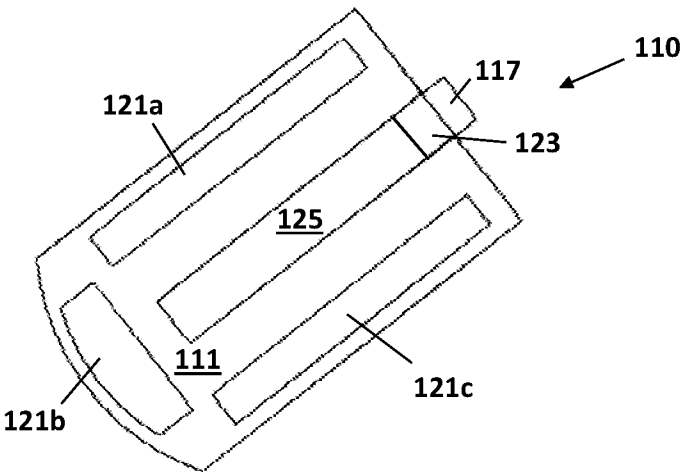
FIG. 3 is a schematic illustration of a bottom view of the shoe lace replacement overlay of FIG. 1, constructed according to the present invention.

With respect to FIG. 3, there is illustrated the back side of shoe lace replacement overlay 110. As shown in FIG. 3, the back side of shoe lace replacement overlay 110 includes, in part, a plurality of shoe replacement overlay attachments 121*a*, 121*b*, and 121*c*. Shoe replacement overlay attachments 121*a*, 121*b*, and 121*c* can be, but are not limited to, a hook-and-loop (e.g., a VELCRO® brand) fastener, snaps, zipper, hooks, magnets or any other suitable, durable attachment means. It is to be understood that shoe replacement overlay attachments 121*a*, 121*b*, and 121*c* are conventionally attached to shoe lace replacement overlay base 111 by any suitable techniques such as adhesives. It is to be further understood that shoe replacement overlay attachments 121*a*, 121*b*, and 121*c* must be able to properly connect to shoe replacement overlay attachments 157. For example, if shoe replacement overlay attachments 121*a*, 121*b*, and 121*c* are constructed of Velcro® then the shoe replacement overlay attachments 157 must also be constructed of Velcro® such that shoe replacement overlay attachments 121*a*, 121*b*, and 121*c* can properly attach to shoe replacement overlay attachments 157. Furthermore, if shoe replacement overlay attachments 121*a*, 121*b*, and 121*c* are constructed of magnets then the shoe replacement overlay attachments 157 must be constructed of magnets, or a ferromagnetic material, such as steel or other metal, such that shoe replacement overlay attachments 121*a*, 121*b*, and 121*c* can properly attach to shoe replacement overlay attachments 157. This is another unique aspect of the present invention in that the use of shoe replacement overlay attachments 121*a*, 121*b*, and 121*c* and shoe replacement overlay attachments 157 allow the wearer to quickly and easily remove and replace shoe lace replacement overlay 110.

Regarding tab or loop 117, as shown in FIG. 3, tab or loop 117 is conventionally attached to the back side of shoe lace replacement overlay 110 at tab attachment 123. It is to be understood that tab or loop 117 can be constructed such that tab or loop 117 includes tab attachment 123 so that tab or loop 117 can be easily attached to shoe lace replacement overlay 110.

In an alternative embodiment, overlay attachments 121*a*, 121*b*, and 121*c* may be continuous, such as being a single piece or abutting next to each other. Also, the overlay attachments 121*a*, 121*b*, 121*c* and 157 may be constructed to be water-resistant or waterproof when attached. Also, shoe 101 and overlay base 111 may be made of a water-resistant or waterproof material. Therefore, when overlay attachments 121*a*, 121*b*, 121*c* of overlay base 111 are securely attached to overlay attachment 157, it makes the shoe water-resistant or waterproof up to the top of the overlay 110. This covers the notch/tongue opening preventing water from entering the shoe 101. This is an improvement over conventional shoes which only have a tongue which is not attached on its sides and has openings on both sides of the tongue which leak.

Figure 4:
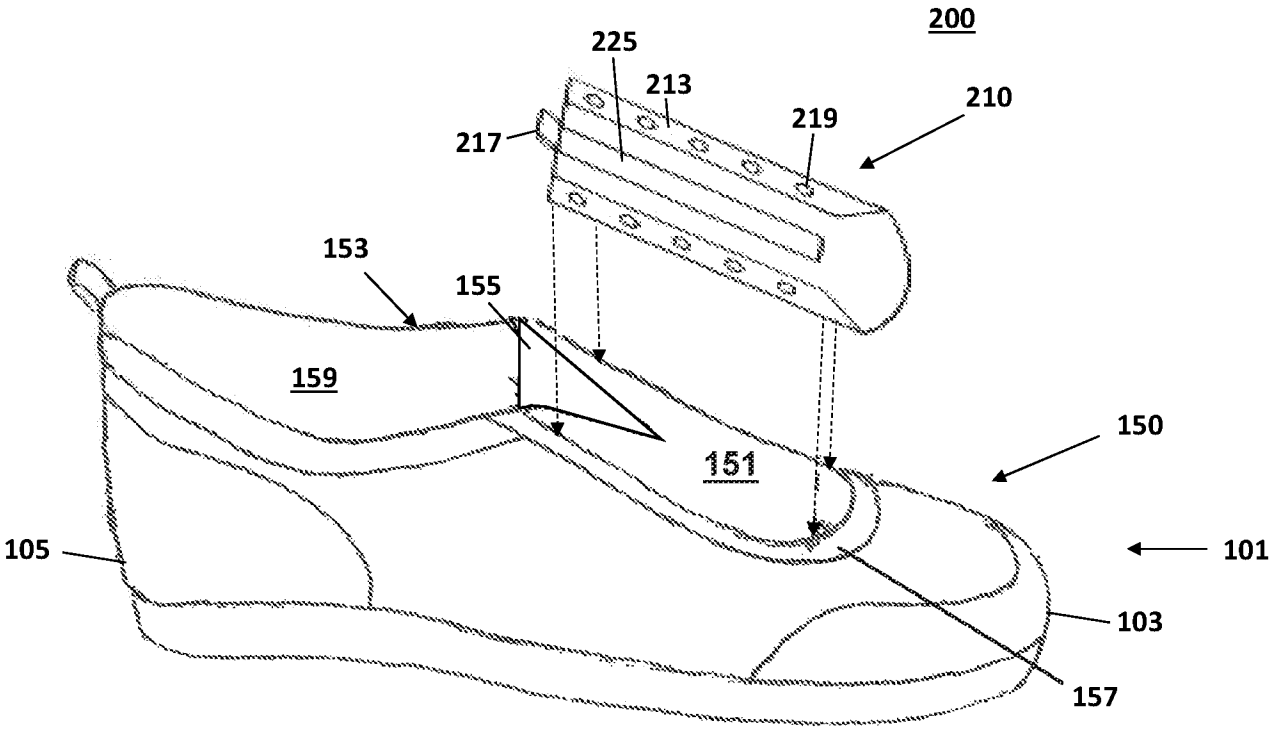
FIG. 4 is a schematic illustration of a shoe having another embodiment of a shoe lace replacement overlay, constructed according to the present invention.

With respect to FIG. 4, there is illustrated another shoe lace replacement overlay system 200 that is constructed according to the present invention. Shoe lace replacement overlay system 200 includes, in part, shoe 101 and shoe lace replacement overlay 210. It is to be understood that shoe lace replacement overlay system 200 is constructed in substantially the same manner as shoe lace replacement overlay system 100 except for the use of shoe lace replacement overlay 210. As will be discussed later, shoe lace replacement overlay 210 may or may not include any laces.

Figure 5:
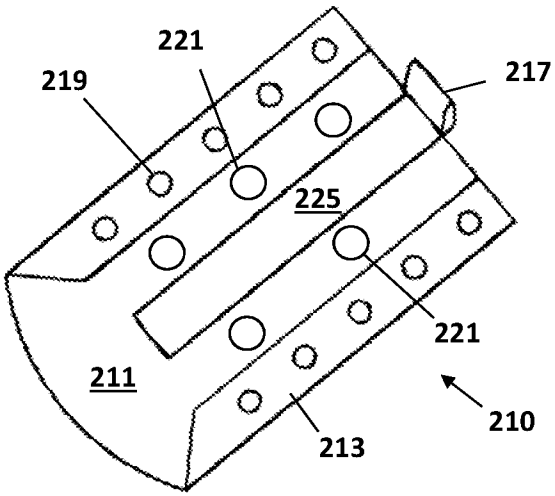
FIG. 5 is a schematic illustration of a top view of the shoe lace replacement overlay of FIG. 4, constructed according to the present invention.

With respect to shoe lace replacement overlay 210 as shown in FIG. 5, shoe lace replacement overlay 210 includes, in part, shoe lace replacement overlay base 211, eyelet strips 213, tab or loop 217, eyelets 219, decoration 221, and elastic member/shoe lace replacement overlay tightener ("Overlay Tightener") 225. It is to be understood that shoe lace replacement overlay base 211 can be constructed of any suitable, durable material such as leather, vinyl or any other suitable stretchable material. However, it is to be further understood that shoe lace replacement overlay base 211, eyelet strips 213 and shoe base 150 should be constructed of substantially the same material. It is to be even further understood that eyelets 219 can be constructed of any suitable, durable material such as polymeric or metallic materials. It is to be understood that Overlay Tightener 225 is located on shoe lace replacement overlay base 211 and is a conventional elastic member that can be used to assist in providing some flexibility on the shoe lace replacement overlay base 211 and to assist in keeping the shoe lace replacement overlay 210 upon the shoe 101.

Regarding eyelet strips 213, as shown in FIGS. 4 and 5, eyelet strips 213 are conventionally formed on shoe lace replacement overlay base 211 by well-known strip folding/forming techniques, the important point being that eyelet strips 213 must be wide enough to provide the proper amount of material to properly retain eyelets 219 within eyelet strips 213 and still somewhat resemble the top of a conventionally tied shoe.

Regarding tab or loop 217, as shown in FIGS. 4 and 5, tab or loop 217 is used to easily remove shoe lace replacement overlay 210 from the shoe lace region 151 and shoe replacement overlay attachments 157. As will be discussed in greater detail later, tab or loop 217 should be constructed so that the wearer can easily grip tab or loop 217. It is to be understood that tab or loop 217 should be constructed of any suitable, durable material such as leather, vinyl or heavy-duty elastic so that the finger of the wearer can easily fit in the tab or loop 217 in order to remove shoe lace replacement overlay 210 from shoe lace region 151 and shoe replacement overlay attachments 157.

Regarding the back side of shoe lace replacement overlay 210, the back side of shoe lace replacement overlay 210 is constructed in the same manner as the back side of shoe lace replacement overlay 110.

With respect to FIGS. 4 and 5, another unique inventive aspect of the present invention is that shoe lace replacement overlay 210 may not include laces. (In another alternative embodiment, it may include laces.) It is to be understood that shoe lace replacement overlay 210 can include a variety of decorative attachments 221 such as labels, decorations, decals, logos, stickers or the like. In this manner, shoe lace replacement overlay 210 can be quickly and easily replaced with another different shoe lace replacement overlay 210 depending upon the decorative attachment that the wearer wishes to display on the shoe 101.

With reference now to FIGS. 1-5, the use of shoe lace replacement overlays 110 and 210 will now be discussed. Initially, if the wearer is going to utilize the shoe lace replacement overlay 110, the wearer then determines the color of the laces and possibly the design in which the laces are to be laced in eyelets 119.

After the color and design of laces have been determined, the wearer simply laces the desired colored laces through eyelets 119 in the desired lacing pattern.

Once the laces have been laced in eyelets 119, the wearer then attaches shoe lace replacement overlays 110 to the shoe 101 by locating shoe lace replacement overlays 110 over shoe lace region 151 and attaching shoe replacement overlay attachments 121*a*, 121*b*, and 121*c* to shoe replacement overlay attachments 157. It is to be understood that tab or loop 117 can then be used to easily and quickly remove shoe lace replacement overlay 110 from shoe 101 if the wearer determines that a different shoe lace replacement overlay 110 is to be attached to shoe 101.

If the wearer is going to utilize the shoe lace replacement overlay 210, the wearer then determines the decorative attachments that are to be attached to shoe lace replacement overlay base 211.

After the decorative attachments have been determined, the wearer may conventionally apply the decorative attachments or simply select the shoe lace replacement overlay 210 that includes the desired decorative attachment.

Once the decorative attachments have been attached or the desired shoe lace replacement overlay 210 that includes the desired decorative attachment has been selected, the wearer then locates shoe lace replacement overlays 110 over shoe lace region 151 and attaches shoe lace replacement overlays 210 to the shoe 101 by attaching shoe replacement overlay attachments 121*a*, 121*b*, and 121*c* (FIG. 1) to shoe replacement overlay attachments 157. It is to be understood that tab or loop 217 can then be used to easily and quickly remove shoe lace replacement overlay 210 from shoe 101 if the wearer determines that a different shoe lace replacement overlay 210 is to be attached to shoe 101.

Figure 6:
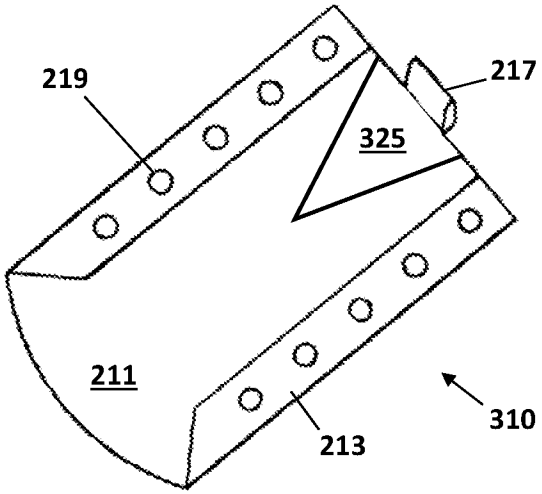
FIG. 6 is a schematic illustration of a top view of another embodiment of the shoe lace replacement overlay constructed according to the present invention.

FIG. 6 is a schematic illustration of a top view of another embodiment of a shoe lace replacement overlay 310 constructed according to the present invention. This is shown without the laces for clarity. It is to be understood that the laces are to be added when the current invention is being used.

In this embodiment, elastic member/shoe lace replacement overlay tightener ("Overlay Tightener") 325 is made of an elastic material and can stretch. It functions in a similar manner as Overlay Tighteners 125 and 225 allowing some stretching, generally in a direction which is perpendicular to that of a line between the toe portion 103 and the heel portion 105. This is referred to as a 'side-to-side' direction.

However, Overlay Tightener 325 has a generally triangular shape which starts wide near the shoe opening 159 and narrows toward an end closest to the toe. This approximates the shape, location, position and dimensions of elastic member/shoe tightener 155 in the shoe 101.

Therefore, the Overlay Tightener 325 will be able to stretch the same amount as the elastic member/shoe tightener 155 in the shoe at a same distance from the shoe opening 159. It is believed that when a person wearing the shoe lace replacement overlay system according to the current invention jumps or applies additional pressure on the shoe base 101, it causes the elastic member/shoe tightener 155 in the shoe to expand a greatest amount near the foot opening 159 and expands in regressively smaller amounts for portions of the elastic member/shoe tightener 155 that are closer to the toe of the shoe base 101.

Similarly, the Overlay Tightener 325 in the overlay 310 will expand a greatest amount near the foot opening 159 and expands in smaller amounts at portions of the Overlay Tightener 325 moving closer to the toe section 103 of the shoe base 101. Since the expansion of overlay 310 is designed to approximate the expansion of elastic member/shoe tightener 155 in the shoe base 101, there is less chance that overlay attachments 121*a*, 121*b* and 121*c* will be pulled away from shoe replacement overlay attachments 157, detaching the overlay 310 from the shoe lace region 151. This is an advantage in that the system 100 holds together better than if there were no elastic member in the Overlay Tightener 325, and if it did not have the shape similar to that disclosed.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Applicants reserve the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein are a new and improved shoe lace replacement overlay. The preferred shoe lace replacement overlay, according to various embodiments of the present invention, offers the following advantages: ease of use of the shoe lace replacement overlay; lightness in weight; the ability to quickly change from one shoe lace replacement overlay to another; the ability to use a variety of different shoe lace colors; the ability to use a variety of different shoe lace overlay designs; excellent durability; portability; and cost efficiency. In fact, in many of the preferred embodiments, these advantages of ease of use of the shoe lace replacement overlay, lightness in weight, the ability to quickly change from one shoe lace replacement overlay to another, the ability to use a variety of different shoe lace colors, the ability to use a variety of different shoe lace overlay designs, excellent durability, portability, and cost efficiency are optimized to an extent that is considerably higher than heretofore achieved in prior, known shoe overlays, spats or saddles.

I claim:

1. A shoe lace replacement overlay system, comprising:

a shoe, wherein the shoe includes a shoe base, a shoe lace region located above the shoe base, a notch area located above the shoe lace region such that the notch area includes an elastic member, wherein the elastic member is operatively connected to the notch area for retaining the shoe on a foot of a wearer, and first shoe replacement overlay attachments located on a periphery around the shoe lace region; and replaceable shoe lace replacement overlays, each overlay having a top side and a bottom side, wherein the top side of each shoe lace replacement overlay includes a shoe lace replacement overlay base having a first area and a second area, a plurality of eyelet strips located along the first and second areas, an elastic member located substantially between the plurality of eyelet strips, a plurality of eyelets located along a length of each of the plurality of eyelet strips, and a shoe lace such that portions of the shoe lace are located within the eyelets in order to form the shoe lace in a desired pattern such that a color of each shoe lace is different for each of the replaceable shoe lace replacement overlays, and wherein the bottom side of each shoe lace replacement overlay includes second shoe replacement overlay attachments such that the first shoe replacement overlay attachments and the second shoe replacement overlay attachments interact with each other in order to retain the shoe lace replacement overlay on the shoe lace region, wherein a one of the shoe lace replacement overlays covers the shoe lace region, the first shoe replacement overlay attachments, the notch area, and the elastic member of the notch area to prevent water from entering the shoe at the notch area.

2. The shoe lace replacement overlay system, according to claim 1, wherein at least one of the first shoe replacement overlay attachments of the shoe lace replacement overlays is further comprised of:

magnets.

3. The shoe lace replacement overlay system, according to claim 1, wherein at least one of the second shoe replacement overlay attachments of the shoe lace replacement overlays is further comprised of:

magnets.

4. The shoe lace replacement overlay system, according to claim 1, wherein each shoe lace replacement overlay is further comprised of:

a first end, and a tab operatively connected to the first end.

5. The shoe lace replacement overlay system, according to claim 1, wherein each shoe lace replacement overlay base is constructed of durable material.

6. The shoe lace replacement overlay system, according to claim 1, wherein each of the eyelet strips are constructed of durable material.

7. A shoe having a shoe lace replacement overlay system, comprising:

a shoe, wherein the shoe includes a shoe base, a shoe lace region located above the shoe base, a notch area located above the shoe lace region such that the notch area includes an elastic member, wherein the elastic member is operatively connected to the notch area for retaining the shoe on a foot of a wearer, and first shoe replacement overlay attachments located on a periphery around the shoe lace region;

and replaceable shoe lace replacement overlays, each overlay having a top side and a bottom side, wherein the top side of each shoe lace replacement overlay includes a shoe lace replacement overlay base having a first area and a second area, a plurality of eyelet strips located along the first and second areas, an elastic member located substantially between the plurality of eyelet strips, a plurality of eyelets located along a length of each of the plurality of eyelet strips, and a shoe lace such that portions of the shoe lace are located within the eyelets in order to form the shoe lace in a desired pattern such that a color of each shoe lace is different for each of the replaceable shoe lace replacement overlays, and wherein the bottom side of the shoe lace replacement overlay includes second shoe replacement overlay attachments such that the first shoe replacement overlay attachments and the second shoe replacement overlay attachments interact with each other in order to retain the shoe lace replacement overlay on the shoe lace region, wherein a one of the shoe lace replacement overlays covers the shoe lace region, the notch area, and the elastic member of the notch area to prevent water from entering the shoe at the notch area.

8. The shoe lace replacement overlay system, according to claim 7, wherein at least one of the first shoe replacement overlay attachments of the shoe lace replacement overlays is further comprised of:

magnets.

9. The shoe lace replacement overlay system, according to claim 8, wherein at least one of the second shoe replacement overlay attachments of the shoe lace replacement overlays is further comprised of:

magnets.

10. The shoe lace replacement overlay system, according to claim 8, wherein each shoe lace replacement overlay is further comprised of:

a first end, and a tab operatively connected to the first end.

11. The shoe lace replacement overlay system, according to claim 9, wherein each shoe lace replacement overlay base is constructed of durable material.

12. The shoe lace replacement overlay system, according to claim 9, wherein each of the eyelet strips are constructed of durable material.

13. The shoe lace replacement overlay system, according to claim 7, wherein the notch area in the shoe, the elastic member in the notch area and the elastic member in the overlay are wider near a foot opening than at a portion closer to a shoe toe.

14. A method of constructing a shoe lace replacement overlay system, comprising:

providing a shoe, wherein the shoe includes a shoe base, a shoe lace region located above the shoe base, a notch area located above the shoe lace region such that the notch area includes an elastic member, wherein the elastic member is operatively connected to the notch area for retaining the shoe on a foot of a wearer, and first shoe replacement overlay attachments located on a periphery around the shoe lace region;

providing replaceable shoe lace replacement overlays, each overlay having a top side and a bottom side, wherein the top side of each shoe lace replacement overlay includes a shoe lace replacement overlay base having a first area and a second area, a plurality of eyelet strips located along the first and second areas, an elastic member located substantially between the plurality of eyelet strips, a plurality of eyelets located along a length of each of the plurality of eyelet strips, and a shoe lace such that portions of the shoe lace are located within the eyelets in order to form the shoe lace in a desired pattern such that a color of each shoe lace is different for each of the replaceable shoe lace replacement overlays, and wherein the bottom side of the shoe lace replacement overlay includes second shoe replacement overlay attachments such that the first shoe replacement overlay attachments and the second shoe replacement overlay attachments interact with each other in order to retain the shoe lace replacement overlay on the shoe lace region; and attaching the bottom side of the shoe lace replacement overlay to the shoe such that a one of the shoe lace replacement overlays covers the shoe lace region, the notch area, and the elastic member of the notch area to prevent water from entering the shoe at the notch area.

15. The method of constructing the shoe lace replacement overlay system, according to claim 14, wherein the method is further comprised of the step of:

using a tab, operatively connected to a first end of the one of the shoe lace replacement overlays, to remove one of the shoe lace replacement overlays from the shoe.

16. The method of constructing the shoe lace replacement overlay system shoe, according to claim 14, wherein at least one of the first shoe replacement overlay attachments of the shoe replacement overlays is further comprised of:

magnets.

17. The method of constructing the shoe lace replacement overlay system shoe, according to claim 16, wherein at least one of second shoe replacement overlay attachments of the shoe replacement overlays is further comprised of:

magnets.

* * * * *